US005437109A

United States Patent [19]

Culp

[11] Patent Number: 5,437,109

[45] Date of Patent: Aug. 1, 1995

[54] AERODYNAMIC SURFACING FOR IMPROVED AIR CIRCULATION THROUGH A KILN FOR DRYING LUMBER

[76] Inventor: George Culp, 318 S. Main St., New London, Stanley County, N.C. 28127

[21] Appl. No.: 126,090

[22] Filed: Sep. 23, 1993

[51] Int. Cl.[6] ..... F26B 21/06

[52] U.S. Cl. ..... 34/231; 34/487

[58] Field of Search ..... 34/306, 191, 443, 462, 34/463, 464, 465, 466, 487, 488, 492, 518, 218, 222, 226, 229, 230, 231

[56] References Cited

U.S. PATENT DOCUMENTS

| | | |
|---|---|---|
| 15,316 | 3/1922 | Weiss . |
| 217,022 | 7/1879 | Robbins . |
| D. 328,137 | 7/1992 | Warrent et al. . |
| 473,116 | 3/1892 | Hay . |
| 528,496 | 10/1894 | Williams . |
| 555,067 | 2/1896 | Bemis . |
| 620,114 | 2/1899 | Ferrell . |
| 620,869 | 3/1899 | Horton . |
| 942,150 | 12/1909 | Tiemann . |
| 1,054,597 | 2/1913 | La Fayette Moore . |
| 1,212,583 | 1/1917 | Tanner . |
| 1,276,979 | 8/1918 | Sidman . |
| 1,328,662 | 1/1920 | Fish, Jr. . |
| 1,339,374 | 5/1920 | Buensod . |
| 1,432,248 | 10/1922 | Hirt . |
| 1,467,306 | 9/1923 | Carrier . |
| 1,497,362 | 6/1924 | Dhe . |
| 1,539,817 | 5/1925 | Thelen . |
| 1,541,433 | 6/1925 | Nikaido . |
| 1,594,549 | 8/1926 | Noel . |
| 1,603,103 | 10/1926 | Anderson . |
| 1,693,395 | 11/1928 | Lawton . |
| 1,840,523 | 1/1932 | Mueller . |
| 1,863,943 | 6/1932 | Rubin . |
| 1,919,646 | 7/1933 | Woolhouse . |
| 1,972,346 | 9/1934 | Juline . |
| 2,085,634 | 6/1937 | Cobb . |
| 2,213,668 | 9/1940 | Dundas et al. . |
| 2,315,285 | 3/1943 | Dennington . |
| 2,318,027 | 5/1943 | Sykes et al. . |
| 2,388,184 | 10/1945 | Ripper . |
| 2,448,288 | 8/1948 | Alk . |
| 2,538,888 | 1/1951 | Smith . |
| 2,718,713 | 9/1955 | Bloxham . |
| 3,149,932 | 9/1964 | Bachrich . |
| 3,337,967 | 8/1967 | Smith . |
| 3,386,186 | 6/1968 | Tiefenbach . |
| 3,598,067 | 8/1971 | Jones . |
| 3,659,352 | 5/1972 | Cook . |
| 3,675,600 | 7/1972 | Jones . |
| 3,680,219 | 8/1972 | Koch . |
| 3,716,004 | 2/1973 | Jones . |
| 3,900,957 | 8/1975 | Denton et al. . |
| 4,014,107 | 3/1977 | Bachirch . |
| 4,188,878 | 2/1980 | Kahnau . |
| 4,199,870 | 4/1980 | Arsenault . |
| 4,250,629 | 2/1981 | Lewis . |
| 4,343,095 | 8/1982 | Rosen et al. . |
| 4,663,860 | 5/1987 | Beall . |
| 4,788,777 | 12/1988 | Davis . |
| 4,955,146 | 9/1990 | Bollinger . |
| 4,972,604 | 11/1990 | Breckenridge . |
| 5,107,607 | 4/1992 | Mason ..... 34/191 |

FOREIGN PATENT DOCUMENTS

| | | | |
|---|---|---|---|
| 699870 | 12/1964 | Canada | 34/488 |
| 3321673 | 12/1984 | Germany | 34/218 |
| 901722 | 1/1982 | U.S.S.R. | 34/488 |

*Primary Examiner*—Henry A. Bennet
*Assistant Examiner*—William C. Doerrler
*Attorney, Agent, or Firm*—Bell, Seltzer, Park & Gibson

[57] ABSTRACT

The kiln system for drying green lumber to a predetermined moisture content according to the present invention includes a kiln chamber for enclosing a charge of lumber, a fan in upper portions of the kiln chamber above the stacks of lumber to circulate air through the kiln chamber and through the lumber in the kiln chamber and a first elongate fairing overlying and partially surrounding an upper corner of the charge of lumber. The elongate fairing controls the air flow from the fan in the upper portions of the chamber to increase the efficiency of the air flow and the drying process. For kiln chambers adapted to receive a charge of lumber consisting of a plurality of laterally spaced rectangular stacks of lumber, the elongate fairing preferably overlies and partially surrounds the outer upper corners of the outermost stacks of lumber.

33 Claims, 2 Drawing Sheets

AERODYNAMIC SURFACING FOR IMPROVED AIR CIRCULATION THROUGH A KILN FOR DRYING LUMBER

FIELD OF THE INVENTION

The present invention relates to the field of kiln drying and, more particularly, to a method and apparatus of kiln drying which includes aerodynamic surfacing for improved air circulation.

BACKGROUND OF THE INVENTION

Lumber which has recently been cut and machined contains a relatively large percentage of water and is referred to as green lumber. Prior to being used in construction or other applications which demand good grades of lumber, the green lumber must be dried to remove a relatively large percentage of water from the lumber. Acceptable water content will vary with the application as well as the type of wood, however, in many circumstances, a moisture content of 19% or less is an acceptable water content.

Although lumber may be air dried, kiln drying accelerates and provides increased control over the drying process. In kiln drying, a charge of lumber is placed in a kiln chamber. A typical kiln chamber is a generally chambers typically have reversible fans for circulating the air through the chamber.

The charge of lumber placed in the kiln generally consists of a number of rectangular solid stacks of lumber. Each stack of lumber, in turn, typically consists of a number of vertically stacked, horizontal rows of lumber that form a rectangular solid. The horizontal rows are spaced apart for air to pass between the rows using wooden boards referred to as "stickers" that have a relatively small lateral cross-sectional area in relation to the lateral cross-sectional area of the lumber forming the charge. The stickers are generally spaced apart between each horizontal row to allow air to flow between the rows.

Typically, the stacks of lumber are placed on separate wheeled, flat bed cars which are mounted for movement on railroad-type tracks. Kilns may have any desired number of tracks. Multi-track kilns may therefore accept several stacks of lumber during each drying cycle.

In operation, a charge of green lumber is initially placed in a kiln chamber. After sealing the kiln chamber, the air within the kiln is heated to facilitate drying. The air may be heated in a number of ways such as by heat transfer from pipes extending through the kiln chamber in which steam flows. Alternatively, heated air may be introduced such as from a furnace. Kilns which utilize the introduction of heated air are typically referred to as direct fired kilns.

Fans generally positioned in upper portions of the kiln and above the stacked lumber circulate the heated air through the kiln chamber, including the stacks of lumber. Because the stickers provide spacing between the horizontal rows of lumber, the heated air passes between the rows of lumber and is in direct contact with both the upper and lower surfaces of the individual pieces of lumber. The fans continually recirculate the air through the kiln and the lumber to further dry the lumber. Periodically, a portion of the circulating air is exhausted from the kiln and additional air is introduced into the kiln. The additional air is typically heated in the kiln chamber, such as by heat transfer from the steam pipes. This periodic exhaust and replacement process allows circulating air which has absorbed a large amount of moisture from the green lumber to be removed, while drier air is introduced to accelerate the lumber's drying.

Within such kilns, the circulating air flows in a generally circular pattern. More particularly, fans above the stacks of lumber direct air laterally over the top of the lumber in a first direction. When the air contacts a first sidewall of the kiln chamber, the bulk of the air is forced downward by the fans and the ceiling of the kiln chamber. The circulating air subsequently flows through the spaces between the horizontal rows of lumber established by the stickers in a second, lateral direction opposite the first lateral direction. Upon contact with a second sidewall of the kiln chamber, the air rises and is recirculated by the fans through the lumber. Periodically, the fans are reversed such that the air flows in the opposite direction to provide generally consistent drying of the lumber.

Kiln chambers are generally rectangular in lateral cross-section. Further, the stacks of lumber are generally rectangular in lateral cross-section since they are comprised of a number of vertically stacked, horizontal rows of substantially equal width. Accordingly, the airflow within the kiln chamber does not proceed smoothly in the circulation path established by the fan. Instead, turbulence is introduced by, among other things, the sharp corners and flat walls of the kiln chamber and the sharp corners of the stacks of lumber.

In particular, the upper corners of the stacks of lumber about which the circulating air must pass creates significant turbulence and may establish localized eddy currents. While in some instances air turbulence is beneficial, the turbulence created by the upper corner of the stacks of lumber and the establishment of eddy currents prevents the smooth circulation of air to and from the fans and decreases the drying efficiency of the lumber since less air flows over the surface of the lumber decreasing the drying capacity of the kiln. Since it is expensive and time consuming to heat the air to dry the lumber, the resultant increase in drying time significantly increases the expense of kiln drying.

OBJECT AND SUMMARY OF THE INVENTION

Accordingly, it is an object of the present invention to provide aerodynamic surfacing for a lumber drying kiln which provides improved air circulation with a corresponding decrease in nonproductive air turbulence.

In one embodiment, an elongate fairing overlies and partially surrounds an upper corner of a rectangular stack of lumber which is enclosed within a kiln chamber. The elongate fairing helps to control the flow of circulating air to and from the fans in the upper portions of the kiln chamber to thereby increase the efficiency of the airflow and drying process.

In another embodiment, first and second fairings overlie and partially surround the outer upper corners of the two outermost stacks of lumber of the plurality of stacks of lumber which are enclosed within a kiln chamber. The first and second elongate fairings direct the air about the upper corner of the stacks of lumber to improve the drying process.

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION OF A PREFERRED EMBODIMENT

Figure 1:
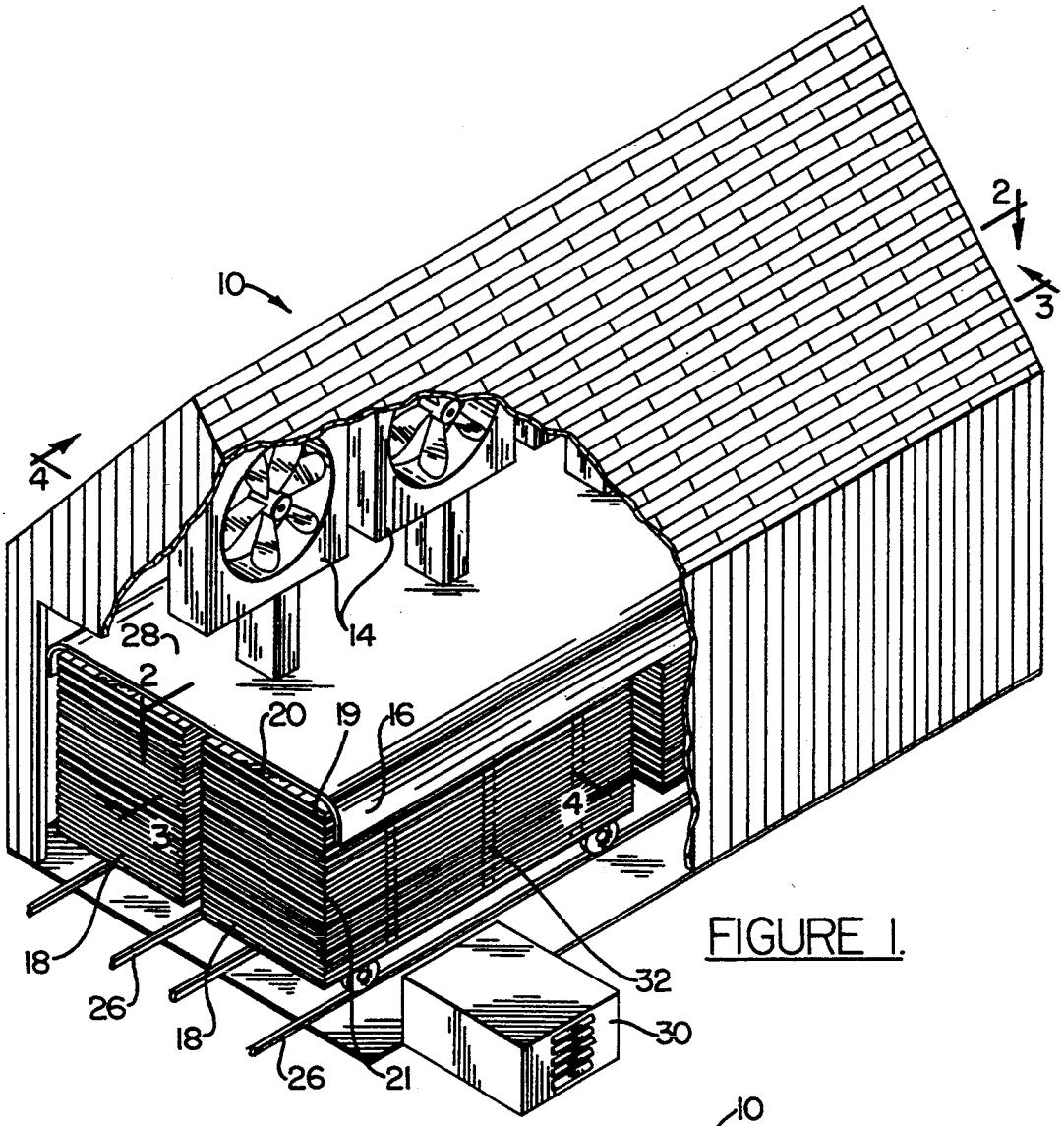
FIG. 1 is a fragmented perspective view of a kiln system according to the present invention.

The present invention is a method and apparatus for improving the circulation of air through a kiln chamber and, consequently, increasing the efficiency with which green lumber is dried. As illustrated in FIG. 1, a kiln chamber 10 for drying lumber is illustrated. The kiln chamber 10 has a lower portion defining a generally rectangular solid space for enclosing a charge of lumber. The charge of lumber consists of a plurality of rectangular solid stacks of lumber 18. It will be understood, however, that the phrase "rectangular solid" is used descriptively, rather than as a limitation, and represents the general interior shape of a typical kiln, or the portion of some other shape of kiln that will hold a stack of lumber to be dried.

Figure 2:
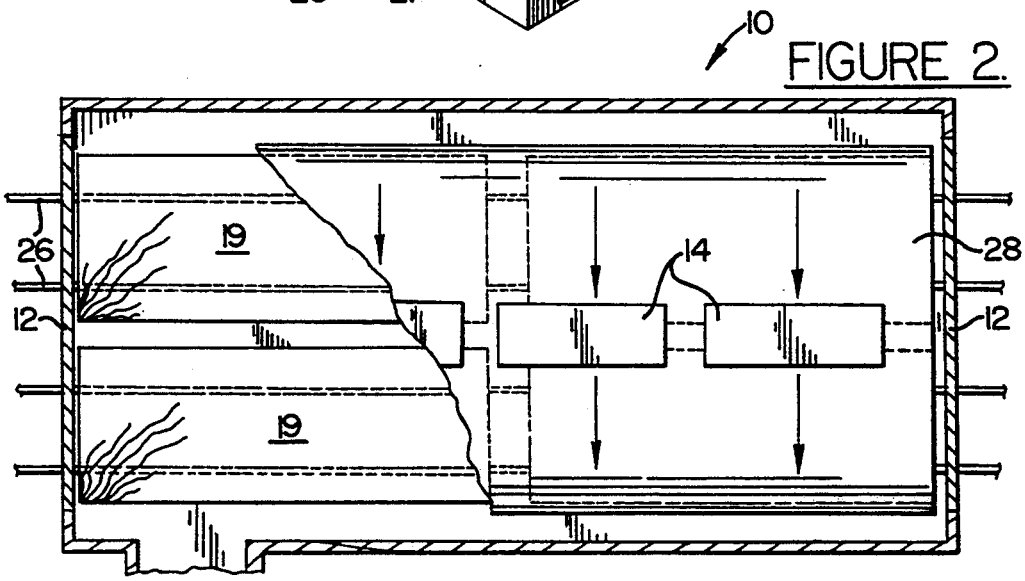
FIG. 2 is a cross-sectional plan view of the kiln system according to the present invention taken along line 2—2 of FIG. 1.

The kiln chamber 10 also preferably includes a set of doors 12 on one sidewall of the kiln chamber 10 and, more preferably, two sets of doors on opposed sidewalls. The doors 12 allow lumber to be inserted and withdrawn from the kiln chamber 10. For a kiln chamber 10 having two sets of doors 12 on opposed sidewalls as illustrated in FIG. 2, lumber may be inserted through a first set of doors and withdrawn from a second set of doors, thus increasing the efficiency of the lumber handling. The doors 12 also allow the kiln chamber 10 to be sealed to control the introduction and exhaust of air.

The kiln chamber 10 also includes at least one fan 14. More preferably, the kiln chamber 10 includes a plurality of longitudinally spaced fans 14 for circulating air laterally through the kiln chamber 10. The fans 14 are generally positioned in upper portions of the kiln chamber above the generally rectangular solid space. The fans 14 circulate air through the kiln chamber 10 and the lumber in the kiln chamber 10 in order to draw moisture from the lumber to dry the lumber to an acceptable moisture level. The fans 14 are also preferably reversible to allow the direction of airflow through the kiln chamber 10 to be altered so as to more evenly dry the lumber.

According to the present invention, a first elongate fairing 16 is placed in upper portions of the kiln chamber 10 for improving the circulation of air through the kiln chamber 10 and through the stacks of lumber 18. This improvement in the air circulation increases the efficiency with which the lumber is dried and correspondingly decreases the time and cost in which identical quantities of lumber may be dried to identical moisture levels. The elongate fairing 16 overlies and partially surrounds an upper corner 19 of a rectangular stack of lumber 18 so as to smoothly circulate the air about the relatively square corner of the stack of lumber 18 for return to the fan 14.

The generally rectangular solid stacks of lumber 18 which are placed in the kiln for drying have an upper surface 20, opposed first and second side surfaces 21 and inner and outer upper corners, 22 and 19, respectively, defined by the intersecting edges of the upper surface 20 and the first and second side surfaces 21. The first elongate fairing 16 extends both above the upper surface 20 and laterally adjacent to the first side surface 21 so as to overlie and partially surround the outer upper corner 19 of the rectangular solid stack of lumber 18.

Figure 4:
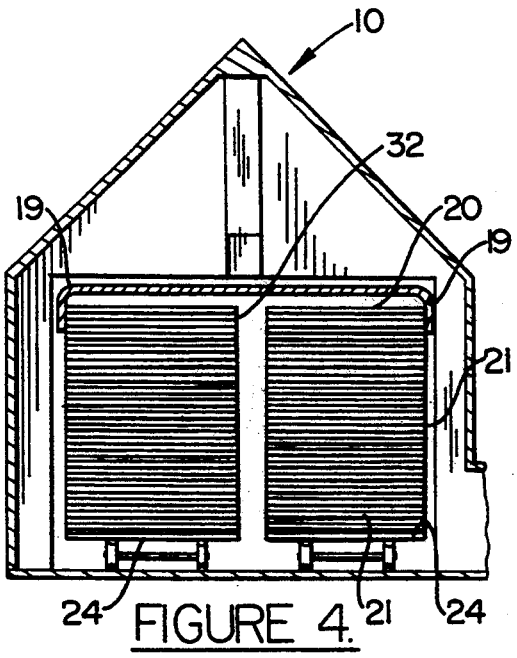
FIG. 4 is a cross-sectional lateral view of the kiln system according to the present invention taken along line 4—4 of FIG. 1.
Figure 5:
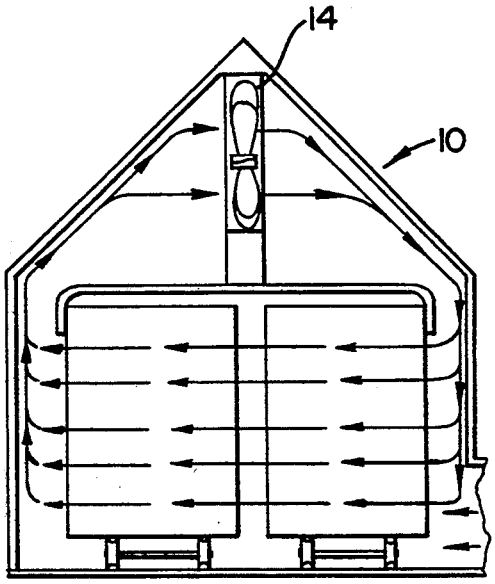
FIG. 5 is a cross-sectional lateral view of the kiln system according to the present invention illustrating a typical airflow pattern through the kiln chamber and through the lumber in the kiln chamber.

As illustrated in FIGS. 4 and 5, the elongate fairing 16 preferably contacts the first side surface 21 to prevent an excessive amount of the circulating air from flowing only over the upper row of lumber and to force the air, instead, further downward about the charge of lumber. If desired, the elongate fairing 16, however, may also be positioned some lateral distance from the first side surface 21.

The first elongate fairing 16 is preferably concave relative to the rectangular stack of lumber 18. The concavity of the elongate fairing facilitates smooth air circulation about the relatively sharp outer upper corner 19 of the rectangular solid stack of lumber 18. More preferably, the first elongate fairing 16 forms a continuous curve in lateral cross-section. This continuous curve is preferably substantially semi-circular to further facilitate efficient air recirculation to the fan 14.

The generally rectangular solid stacks of lumber 18 are typically placed on wheeled cars 24, such as flat bed rail cars, mounted on rail tracks 26 which are preferably formed in the floor of the kiln chamber 10. The wheeled cars 24 facilitate insertion and withdrawal of the stacks of lumber 18 from the kiln chamber 10. Although a kiln chamber 10 having two laterally adjacent tracks of lumber is illustrated, one skilled in the art will know that a kiln chamber incorporating the present invention may include one or more tracks of lumber.

Further, since the length of the kiln chamber 10 is typically greater than the length of the pieces of green lumber being dried, the charge of lumber preferably includes a longitudinal row of a plurality of rectangular solid stacks of lumber. Each longitudinal row of lumber is preferably inserted on one track with the wheeled cars upon which the rectangular solid stacks of lumber are carried being coupled together. Accordingly, the longitudinal row of lumber may be inserted and withdrawn as an unit.

Figure 3:
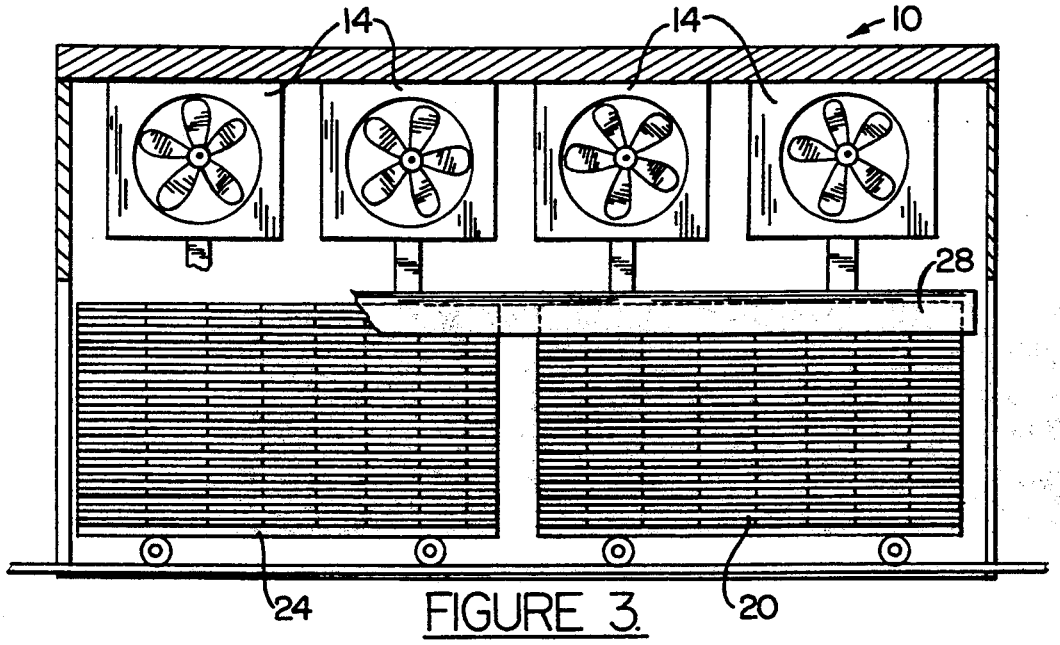
FIG. 3 is a cross-sectional side view of the kiln system according to the present invention taken along line 3—3 of FIG. 1.

Regardless of the number of wheeled cars per track, the kiln chamber 10 is adapted to receive a charge of lumber comprised of at least one rectangular solid stack of lumber 18 and having a predetermined maximum length. Correspondingly, the length of the first elongate fairing 16 is preferably substantially equal to either the predetermined maximum length of the charge of lumber or, if more than one row of lumber is inserted in the kiln chamber 10, the outermost longitudinal rows of lumber 18 as illustrated in FIG. 3.

In preferred embodiments, the kiln chamber 10 is adapted to receive a plurality of laterally spaced, rectangular solid stacks of lumber 18. In such embodiments, the kiln system 10 further comprises a second elongate fairing 28 in the upper portions of the kiln chamber 10. As illustrated in FIG. 1, the first and second elongate fairings overlie and partially surround the outer upper corners of the two laterally spaced rectangular solid stacks of lumber 18. In embodiments in which more than two laterally spaced rectangular solid stacks of lumber are received by the kiln chamber 10, the first and second fairings overlie and partially surround the outer upper corners of the outermost stacks of the plurality of laterally spaced rectangular solid stacks of lumber 18.

While the fairings facilitate the circulation of air from the fan 14, the elongate fairings significantly improve circulation of air to the fan for further recirculation. Since the fans 14 of the kiln chamber are preferably reversible, air will be returned to the fan 14 from both sides of the kiln chamber 10 depending upon the direction of the fans 14. Accordingly, elongate fairings placed over the outer upper corners 19 of both of the outermost stacks of the plurality of laterally spaced rectangular solid stacks of lumber 18 insure that air is recirculated to the fans 14 efficiently from either circulation direction.

In further preferred embodiments, the kiln system of the present invention also includes means for heating the circulating air in the kiln chamber 10 since the circulation of heated air further accelerates the drying process by withdrawing larger quantities of moisture from the lumber. The heating means may include all those known to one skilled in the art, including, without limitation, an external furnace 30 for heating the air prior to its introduction to the kiln chamber 10. Alternatively, the kiln chamber 10 may include pipes extending through the kiln chamber 10 in which heated steam flows such that heat is transferred from the steam flowing through the pipes to the circulating air within the kiln chamber 10.

In other preferred embodiments illustrated in FIG. 4, the plurality of stacked rows of lumber are spaced apart such that air may flow between the rows to increase the lumber's drying. This spacing is preferably provided by the placement of a plurality of spaced apart stickers 32, typically pieces of lumber having a relatively small cross-sectional dimensions in proportion to the cross-sectional dimensions of the lumber being dried, between each row of lumber.

In operation, a charge of lumber consisting of a rectangular solid stack of green lumber 18 having a relatively large moisture content is introduced into the kiln chamber 10 which is subsequently sealed such that air may be controllably introduced into and exhausted from the kiln chamber 10. As illustrated in FIG. 5, the air within the kiln chamber 10 is thereafter circulated through the stack of lumber 18 to draw moisture from the stack. According to the present invention, the circulating air is directed around an upper corner 19 of the stack of lumber 18 such that the majority of the air flows smoothly about the upper corner 19, thus increasing the drying efficiency of the green lumber.

In preferred embodiments, at least a portion of the air is recirculated through the stack of lumber 18 in the kiln chamber 10 to further dry the stack of lumber 18. This recirculation of air preferably includes the selective exhaust of a portion of the circulating air containing moisture drawn from the stack of lumber 18 and the introduction of additional air into the kiln chamber 10. Preferably, the additional air has a lower moisture content than the exhausted air such that it will more rapidly draw moisture from the stack of lumber 18 than the exhausted air, thus, further increasing the efficiency of the drying process. In further preferred embodiments, the air is heated prior to its circulation to further facilitate moisture removal from the stack of lumber 18. Once the lumber has reached an acceptable moisture level, such as 19% or less, or the lumber has been in the kiln chamber 10 for a predetermined length of time, the doors 12 of the kiln chamber 10 may be opened and the charge of lumber removed.

In the specification, typical preferred embodiments of the invention have been disclosed and, although specific terms have been employed, they have been used in the generic and descriptive sense only and not for purposes of limitation, the scope of the invention being set forth in the following claims.

What I claim is:

1. A kiln system for drying green lumber to a predetermined moisture content, said kiln system comprising:

a kiln chamber, lower portions of which define a generally rectangular solid space for enclosing a charge of lumber therein for drying, the charge of lumber comprising at least one rectangular solid stack of lumber;

a fan in upper portions of said kiln chamber and above said generally rectangular solid space for circulating air through said chamber and through lumber in said chamber to thereby dry the lumber; and a first elongate fairing in the upper portions of said kiln chamber for overlying and partially surrounding an upper corner of a rectangular stack of lumber placed in said chamber for drying, said first fairing forming a continuous concave curve, in lateral cross-section, relative to the rectangular stack of lumber for smoothing the airflow in said upper portions of said chamber and around the upper corner of the stack of lumber to thereby increase the efficiency of the airflow about the upper corner of the rectangular stack of lumber and to thereby correspondingly increase the efficiency of the drying process.

2. A kiln system according to claim 1 wherein the rectangular stack of lumber has an upper surface, opposed first and second side surfaces, and an outer upper corner of the rectangular solid stack of lumber defined by the intersecting edges of the upper surface and the first side surface, and wherein said first elongate fairing extends both above the upper horizontal surface and then curves downwardly laterally adjacent to the first side surface.

3. A kiln system according to claim 1 wherein said kiln chamber has a length sufficient to receive rectangular solid stacks of lumber having a predetermined maximum length and said first elongate fairing has a length substantially equal to the predetermined maximum length of the rectangular stacks of lumber.

4. A kiln system according to claim 1 wherein the continuous concave curve is substantially semi-circular.

5. A kiln system according to claim 1 wherein said kiln system further comprises a second elongate fairing in the upper portions of said kiln chamber, wherein both said first and second elongate fairings overlie and partially surround upper corners of the rectangular stack of lumber, whereby said first and second fairings help control the airflow from said fan in said upper portions of said chamber and with respect to the stack of lumber to thereby increase the efficiency of the airflow and the drying process.

6. A kiln system according to claim 5 wherein said kiln chamber has a width sufficient to receive a plurality of laterally spaced, rectangular solid stacks of lumber therein for drying in side-by-side relationship, and wherein said first and second fairings overlie and partially surround an upper corner of the outermost stacks of the plurality of laterally spaced rectangular solid stacks of lumber.

7. A kiln system according to claim 6 wherein said first and second fairings have a length sufficient to extend entirely along and to cover the outermost upper corners of the stack placed in the kiln chamber.

8. The combination of a kiln system for drying green lumber to a predetermined moisture content and a portion of lumber to be dried therein, the combination comprising:

a kiln chamber, lower portions of which define a generally rectangular solid space;

a charge of lumber in said rectangular space in said kiln chamber for being dried therein, said charge comprising at least one rectangular solid stack of lumber;

a fan in upper portions of said kiln chamber and above said generally rectangular solid space for circulating air through said chamber and through lumber in said chamber to thereby dry the lumber; and a first elongate fairing in the upper portions of said kiln chamber for overlying and partially surrounding an upper corner of a rectangular stack of lumber placed in said chamber for drying, said first fairing forming a continuous concave curve, in lateral cross-section, relative to the rectangular stack of lumber for smoothing the airflow in said upper portions of said chamber and around the stack of lumber to thereby increase the efficiency of the airflow about the upper corner of the rectangular stack of lumber and to thereby correspondingly increase the efficiency of the drying process.

9. The combination of a kiln system and lumber according to claim 8 wherein the rectangular stack of lumber has an upper surface, opposed first and second side surfaces, and an outer upper corner of the rectangular solid stack of lumber defined by the intersecting edges of the upper surface and the first side surface, and wherein said first elongate fairing extends both above the upper horizontal surface and then curves downwardly laterally adjacent to the first side surface.

10. The combination of a kiln system and lumber according to claim 8 wherein said kiln chamber has a length sufficient to receive a charge of lumber having a predetermined maximum length and said first elongate fairing has a length substantially equal to the predetermined maximum length of the charge of lumber.

11. The combination of a kiln system and lumber according to claim 8 wherein the continuous concave curve is substantially semi-circular.

12. The combination of a kiln system and lumber according to claim 9 wherein said stack of lumber has an inner upper corner defined by the intersecting edges of the upper surface and the second side surface, and wherein said combination further comprises a second elongate fairing overlying and partially surrounding the inner upper corner for smoothly recirculating air to said fan.

13. The combination of a kiln system and lumber according to claim 12 wherein the charge of lumber has a predetermined maximum length and both said first and second elongate fairings have lengths at least as long as the predetermined maximum length of the charge of lumber.

14. The combination of a kiln system and lumber according to claim 8 wherein said charge of lumber comprises first and second laterally spaced rectangular solid stacks of lumber wherein each of the first and second stacks of lumber have an upper surface, opposed side surfaces, and an outer upper corner defined by the intersecting edges of the respective upper surfaces and the outermost side surfaces of the first and second rectangular solid stacks of lumber, and wherein the combination further comprises a second elongate fairing in the upper portions of the kiln chamber such that said first and second elongate fairings overlie and partially surround the outer upper corners of said first and second said rectangular solid stacks of lumber, respectively, whereby said first and second fairings help control the airflow from the fan in the upper portions of the chamber and with respect to the stack of lumber to thereby increase the efficiency of the airflow in the drying process.

15. The combination of a kiln system and lumber according to claim 14 wherein said fan in upper portions of said kiln chamber overlie an air space defined by the lateral spacing of said first and second rectangular solid stacks of lumber.

16. The combination of a kiln system and lumber according to claim 8 wherein said charge of lumber comprises a plurality of laterally spaced rectangular solid stacks of lumber, and wherein the combination further comprises a second elongate fairing in the upper portions of said kiln chamber wherein both said first and second elongate fairings overlie and partially surround the respective upper corners of the outermost stacks of said plurality of laterally spaced rectangular solid stacks of lumber whereby said first and second fairings help control the airflow from said fan in said upper portions of said chamber and with respect to the stack of lumber to thereby increase the efficiency of the airflow in the drying process.

17. A method of increasing the efficiency of drying green lumber, comprising the steps of:

circulating air through a charge of lumber in a sealed kiln chamber in which air can be controllably introduced into and exhausted from the kiln chamber to thereby draw moisture from the stack of lumber; and smoothing the flow of circulating air by directing at least a portion of the circulating air in a continuously curved airflow pattern adjacent an upper corner of the charge of lumber to smooth and control the flow of circulating air about the upper corner of the charge of lumber and thus provide a more efficient airflow within the chamber to thereby correspondingly dry the lumber more efficiently.

18. A method of drying lumber according to claim 17 wherein the step of directing the circulating air further comprises the step of recirculating at least a portion of the air through the charge of lumber in said kiln chamber to further dry the charge of lumber.

19. A method of drying lumber according to claim 18 wherein the step of recirculating the air includes the steps of selectively exhausting a portion of the circulating air containing moisture drawn from the charge of lumber and introducing additional air into the kiln chamber wherein the additional air has a lower moisture content than the exhausted air.

20. A method of drying lumber according to claim 17 further comprising the step of heating the air prior to its circulation to facilitate moisture removal from each the stack of lumber.

21. A method of drying lumber according to claim 17 wherein the step of directing the airflow in a continuously curved airflow pattern comprises the step of directing the circulating air along an elongate fairing positioned adjacent an upper corner of the charge of lumber such that at least a portion of the air flows in a substantially continuous curve.

22. A method of drying lumber according to claim 17 further comprising the steps of:

introducing a charge of lumber comprised of at least one rectangular solid stack of lumber in the kiln chamber prior to the step of circulating air wherein the rectangular solid stack of lumber comprises a plurality of stacked rows of lumber; and spacing the stacked rows of lumber such that air may flow between the rows to remove moisture therefrom.

23. A method of drying lumber according to claim 22 wherein the step of spacing the stacked rows includes the step of placing a plurality of spaced apart stickers between each row of lumber.

24. A method of drying lumber according to claim 22 wherein the step of introducing a charge of lumber in the kiln chamber further includes the step of introducing a plurality of laterally spaced rectangular solid stacks of lumber into said kiln chamber, said plurality of stacks of lumber including first and second outermost stacks of lumber, each outermost stack of lumber having inner and outer upper corners.

25. A method of drying lumber according to claim 21 wherein the step of directing the circulating air along a fairing includes the step of directing air about the outer upper corners of the first and second outermost stacks of lumber such that air flows smoothly about each of the outer upper corners.

26. A method of drying lumber according to claim 25 wherein both the first and second outermost stacks of lumber are comprised of a longitudinal row of a plurality of individual piles of lumber, each pile of lumber having inner and outer upper corners, and wherein the step of directing a circulating air along the fairing includes the step of directing air about the outer upper corners of each pile of lumber of both the first and second outermost stacks of lumber such that said air flows smoothly about each outer upper corner.

27. A method of increasing the efficiency of drying a rectangular solid stack of green lumber in a sealed kiln chamber in which air circulates to draw moisture from the stacks of lumber, the method comprising smoothing the flow of circulating air by directing at least a portion of the circulating air in a continuously curved airflow pattern adjacent an upper corner of the stack of lumber to smooth and control the flow of circulating air about the upper corner of the charge of lumber and thus provide a more efficient airflow within the chamber to thereby correspondingly dry the lumber more efficiently.

28. A method of drying lumber according to claim 27 further comprising the step of recirculating at least a portion of the air that has passed through the stack at least once to further dry the stack of lumber.

29. A method of drying lumber according to claim 28 further comprising the step of controllably introducing air into the kiln chamber and controllably exhausting air from the kiln chamber, whereby the air introduced has a lower moisture content than the air exhausted.

30. A method of drying lumber according to claim 27 further comprising the step of heating the air prior to its circulation to facilitate moisture removal from the stack of lumber.

31. A method of drying lumber according to claim 26 wherein the rectangular solid stack of lumber is comprised of a plurality of stacked rows of lumber, and wherein the method further comprises the step of spacing the stacked rows of lumber such that air may flow between the rows to remove moisture therefrom.

32. A method of drying lumber according to claim 31 wherein the step of spacing the stacked rows of lumber includes the step of placing a plurality of spaced apart stickers between each row of lumber.

33. A method of drying lumber according to claim 27 wherein the step of smoothing the flow of circulating air comprises the step of directing the circulating air along an elongate fairing positioned adjacent an upper corner of the stack of lumber.

* * * * *